United States Patent [19]

Mott

[11] Patent Number: 4,496,152

[45] Date of Patent: Jan. 29, 1985

[54] RACQUETS WITH PROTECTIVE BUMPER STRIP

[76] Inventor: Jonathan C. Mott, Cranary Cottage, Dunsford Rd., Loxhill, Near Godalming, Surrey, England

[21] Appl. No.: 317,773

[22] Filed: Nov. 3, 1981

[30] Foreign Application Priority Data

Nov. 4, 1980 [GB] United Kingdom ..... 8035375

[51] Int. Cl.[3] ..... A63B 49/14

[52] U.S. Cl. ..... 273/73 C

[58] Field of Search ..... 273/73 R, 73 C, 73 D, 273/326, 82 A, 82 B; D21/211, 212, 213

[56] References Cited

U.S. PATENT DOCUMENTS

| | | | |
|---|---|---|---|
| 3,642,283 | 2/1972 | Wilkens | 273/73 D X |
| 3,664,668 | 5/1972 | Held | 273/73 D |
| 3,899,172 | 8/1975 | Vaughn et al. | 273/73 C |
| 4,019,736 | 4/1977 | Lehew | 273/73 R |
| 4,049,269 | 9/1977 | Blackburne | 273/73 D |
| 4,192,506 | 3/1980 | Sofia | 273/73 R |
| 4,204,681 | 5/1980 | Hall et al. | 273/73 C |
| 4,220,335 | 9/1980 | Nobbs | 273/73 C |

FOREIGN PATENT DOCUMENTS

| | | | |
|---|---|---|---|
| 234324 | 5/1925 | United Kingdom | 273/73 C |
| 252293 | 5/1926 | United Kingdom | 273/73 C |
| 652951 | 5/1951 | United Kingdom | 273/73 C |
| 751040 | 6/1956 | United Kingdom | 273/73 C |

*Primary Examiner*—Paul E. Shapiro
*Assistant Examiner*—Matthew L. Schneider
*Attorney, Agent, or Firm*—Banner, Birch, McKie & Beckett

[57] ABSTRACT

In order to permit a metal-framed racquet to be safely used as a squash racquet, the radially outer surface of the metal frame is provided with two grooves disposed symmetrically one on each side of the median plane of the frame. Each groove has a respective relatively soft, clear plastics bumper member locked therein, the bumper members covering a substantial proportion of the radially outer surface of the frame. The bumper members also serve to trap the heads of stringing grommets in a further groove disposed, in the median plane of the frame, between the grooves in which the bumper strips are locked.

6 Claims, 2 Drawing Figures

RACQUETS WITH PROTECTIVE BUMPER STRIP

This invention relates to racquets, and is more particularly but not exclusively concerned with squash racquets.

At the present time, nearly all squash racquets have wooden frames, since the use of a metal-framed racquet in the confines of a squash court is considered dangerous and is therefore not normally permitted. However, the use of, for example, an aluminium extrusion to make the frame would not only have advantages from a manufacturing viewpoint, in that it could lead to reduced manufacturing costs, but could also result in a stronger, lighter, racquet.

It is therefore an object of the present invention to provide a metal-framed racquet which can be used with relative safety as a squash racquet.

According to the present invention, there is provided a racquet having a metal head or frame, the outer surface of the frame having at least two grooves therein which are disposed one on each side of the median plane of the frame and each extend around a substantial proportion of the circumference of the frame on each side of the point opposite the handle of the racquet, each groove having secured therein a respective relatively soft bumper member which extends over and serves to cover a substantial proportion of the surface of the frame.

Thus the possibility of impacts between the hard surface of the frame and, for example, a player is substantially reduced, and most impacts on the frame will be on the relatively soft bumper members.

Advantageously, each groove is wider at its base than at its mouth, and each bumper member has a mounting portion shaped to substantially fill its respective groove and is slid into its groove from one end thereof during manufacture of the racquet, whereby the bumper members are locked into their respective grooves in the finished racquet.

In a preferred embodiment of the invention, the radially outer surface of the frame has a further groove therein, which extends round the greater part of the circumference of the frame and lies in the median plane of the frame between the two bumper members, the further groove containing the heads of grommets through which the stringing of the racquet passes and each bumper member being shaped and dimensioned to slightly overlie a respective edge of the mouth of the further groove and trap the heads of the grommets therein.

Conveniently, the frame is made from extruded aluminium, and the bumper members are made from a plastics material, for example polyethylene.

Figure 1:
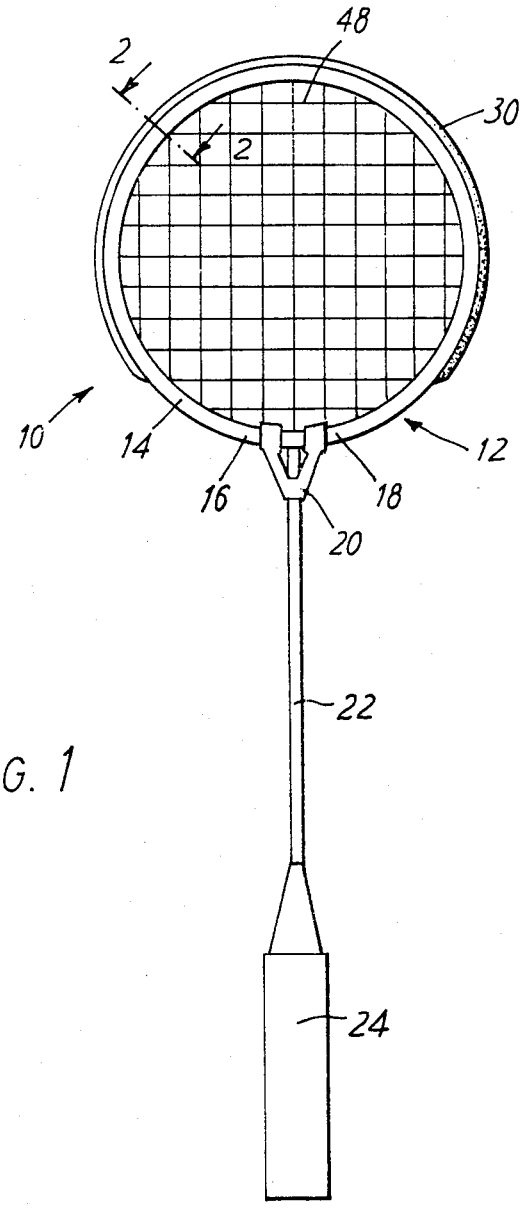
Figure 2:
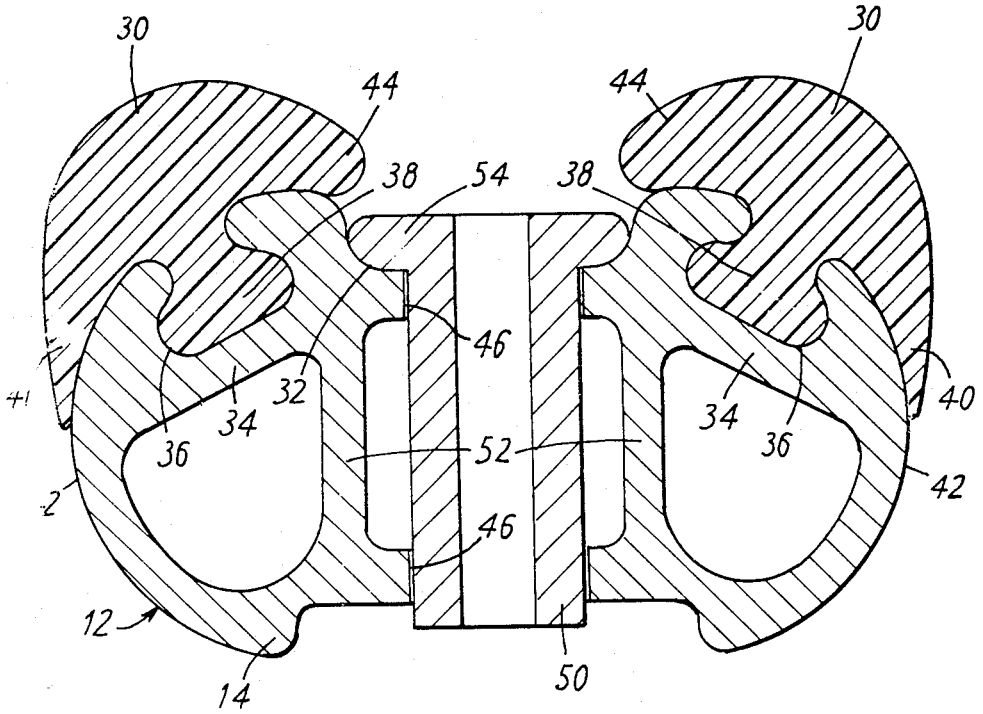

The invention will now be described, by way of non-limitative example only, with reference to the accompanying drawings, of which:

FIG. 1 is a somewhat diagrammatic representation of a squash racquet in accordance with the present invention; and FIG. 2 is an enlarged sectional view of the frame of the racquet in FIG. 1.

The squash racquet illustrated in FIG. 1 is indicated generally at 10, and comprises a substantially round head or frame 12 made from a single length of extruded aluminium tubing 14 bent to form the round shape of the frame, the opposite ends 16, 18 of the tubing 14 abutting each other and being secured within an approximately V-shaped member 20 of the kind described in my U.K. Patent Application No. 79 22108, published under No. 2 033 760A. A handle 22, extending radially outwardly of the frame 12, extends through the base of the V-shaped member 20 and is secured in the frame 12, as described in more detail in my aforementioned U.K. application, and has a sleeve member 24 of suitably-covered plastics, wood or other suitable material fitted over its radially outer end.

In the confines of a squash court, it sometimes happens that one of the players, or a wall of the court, is inadvertently struck by a racquet. To reduce the possibility of injury of the players and damage and/or marking of the walls of the court, the racquet 10 is provided with two similar clear plastics bumper strips 30, e.g. in polyethylene, which are secured to the radially outer surface of the frame 12, one on each side of its median plane, and which extend round more than a quarter of the circumference of the frame on each side of the point opposite the handle 20. Thus the bumper strips 30 each extend round more than half the circumference of the frame 12.

The way in which the bumper strips 30 are secured to the frame 12 can be seen in the sectional view of FIG. 2. Thus the tubing 14 of the frame 12 is provided in the portion of its surface which constitutes the radially outer surface of the frame with a central groove or channel 32, which is symmetrically disposed about the median plane of the frame. Symmetrically disposed on each side of the groove 32, in what are effectively shoulder portions 34 of the radially outer surface of the frame 12, are respective grooves or channels 36, each of which has a base which is wider than its mouth. Each of the bumper strips 30 has a mounting or root portion 38, whose cross sectional shape is complementary to that of the grooves 36 and is secured to the frame by sliding its root portion 38 into its respective groove from one end thereof during manufacture of the racquet, e.g. just prior to the fitting of the V-shaped member 20.

Each bumper strip 30 has a flank portion 40 which extends over and covers a substantial proportion of its respective side face 42 of the frame 12, and a portion 44 which projects slightly over the edge of the mouth of the central groove 32.

Aligned holes 46 whose axes extend approximately radially of the frame 12 are provided in the radially outer and radially inner walls of the tubing 14 of the frame, in the median plane thereof, to permit the racquet 10 to be strung with its stringing 48 (FIG. 1). A respective plastics grommet, such as that indicated at 50 in FIG. 2, extends through each pair of aligned holes 46, between internal bracing walls 52 which also extend radially of the frame 12 and serve to strengthen the tubing 14.

The heads 54 of the grommets 50 are slightly wider than the distance between the respective portions 44 of the bumper strips 30 on each side of the groove 32. During manufacture of the racquet 10, and with the bumper strips 30 in place, the grommets 50 are pressed into their respective aligned holes 46, the portions 44 of the bumper strips being sufficiently resilient to part a little so as to allow the heads 54 of the grommets to pass therebetween. Once in position, the heads 54 of grommets 50 are trapped in the groove 32 by the portions 44 of the bumper strips 30, which greatly facilitates stringing the racquet 10.

It will be appreciated that the bumper strips 30 are significantly softer than the aluminium tubing 14, so that the possibility of injury to a player accidentally struck by the racquet 10 is significantly reduced. However, since the bumper strips 30 are also relatively light, they do not substantially increase the weight of the racquet.

It will also be appreciated that the bumper strips 30 have been designed so that they cannot easily be removed by the player using the racquet 10. However, if they are damaged, they can be replaced by the racquet manufacturer, who, after removing the V-shaped member 20, can slide new ones into the grooves 36.

Many modifications can be made to the described embodiment of the invention. In particular, the bumper strips 30 can be made in a coloured plastics material whose colour is selected to contrast with the colour finish of the tubing 14. Also, the V-shaped member 20 can be replaced by a T-shaped member of the kind described and claimed in my aforementioned U.K. patent application. Further, the invention can also be applied to a racquet having a frame of the general kind disclosed in my U.K. Patent Specification No. 1 603 834.

I claim:

1. A racquet having a metal head and a handle attached to said head, the outer surface of the head having at least two grooves therein which are disposed one on each side of the median plane of the head and each extend around a substantial proportion of the circumference of the head on each side of a point opposite the attachment of the handle to the head, said grooves having a base annd mouth, each groove being wider at its base than at its mouth and having secured therein a respective relatively soft bumper member which extends over and serves to cover a substantial proportion of the outer surface of the head, each bumper member having a mounting portion shaped to substantially fill its respective groove, whereby the bumper members are locked into their respective grooves, and wherein the outer surface of the head has a further groove therein which extends around the greater part of the circumference of the head and lies in the median plane of the head between the two bumper members, the further groove containing grommets through which the stringing of the racquet passes, at least one bumper member being shaped and dimensioned to slightly overlie its respective edge of the mouth of the further groove and trap the grommets therein.

2. A racquet as claimed in claim 1, wherein each bumper member is shaped and dimensioned to slightly overlie a respective edge of the mouth of the further groove and trap the grommets therein.

3. A racquet as claimed in claim 1, wherein the head is made from extruded aluminium.

4. A racquet as claimed in claim 1, wherein the bumper members are made from a plastics material.

5. A racquet as claimed in claim 4, wherein the plastics material is a clear plastics material.

6. A racquet as claimed in claim 4, wherein the bumper members are made from polyethylene.

* * * * *